US009470190B2

(12) United States Patent
Newman et al.

(10) Patent No.: US 9,470,190 B2
(45) Date of Patent: Oct. 18, 2016

(54) ENGINE INTAKE MANIFOLD HAVING A CONDENSATE-CONTAINMENT TRAY

(71) Applicant: Ford Global Technologies, LLC, Dearborn, MI (US)

(72) Inventors: Christopher William Newman, Farmington Hills, MI (US); Jeffrey Richard Kosko, Dearborn, MI (US); Milind B. Kulkarni, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 84 days.

(21) Appl. No.: 14/533,906

(22) Filed: Nov. 5, 2014

(65) Prior Publication Data

US 2016/0123283 A1 May 5, 2016

(51) Int. Cl.

| | |
|---|---|
| ***F02M 35/10*** | (2006.01) |
| ***F01M 13/00*** | (2006.01) |
| ***F02M 35/116*** | (2006.01) |
| ***F01M 13/04*** | (2006.01) |

(52) U.S. Cl.

CPC ..... *F02M 35/10222* (2013.01); *F01M 13/00* (2013.01); *F01M 13/0416* (2013.01); *F02M 35/116* (2013.01); *F01M 2013/0433* (2013.01)

(58) Field of Classification Search

CPC ..... F01M 2013/0038; F01M 2013/005; F01M 13/00; F01M 35/116; F01M 13/0416; F01M 2013/0433; F02M 35/10222; F02M 35/1022

USPC ..... 123/572–574

See application file for complete search history.

(56) References Cited

U.S. PATENT DOCUMENTS

| | | | | |
|---|---|---|---|---|
| 3,172,399 | A * | 3/1965 | Lentz et al. | 123/572 |
| 3,455,284 | A * | 7/1969 | High | 123/572 |
| 4,085,719 | A | 4/1978 | Hamburg et al. | |
| 4,528,969 | A * | 7/1985 | Senga | 123/572 |
| 5,632,145 | A | 5/1997 | Hunt | |
| 6,092,498 | A * | 7/2000 | Lohr et al. | 123/90.38 |
| 6,290,558 | B1 | 9/2001 | Erickson | |
| 6,293,268 | B1 * | 9/2001 | Mammarella | 123/574 |
| 6,412,478 | B1 * | 7/2002 | Ruehlow et al. | 123/572 |
| 7,441,551 | B2 | 10/2008 | Lewis et al. | |
| 7,845,341 | B2 | 12/2010 | Lewis et al. | |
| 8,464,524 | B2 | 6/2013 | Bidner et al. | |
| 8,464,698 | B2 * | 6/2013 | Durkin et al. | 123/573 |
| 2010/0242931 | A1 * | 9/2010 | Huff | 123/574 |
| 2013/0312720 | A1 * | 11/2013 | Aquino | 123/573 |
| 2013/0319244 | A1 | 12/2013 | Ball et al. | |
| 2014/0076294 | A1 * | 3/2014 | Ulrey et al. | 123/572 |
| 2014/0158096 | A1 | 6/2014 | Leone et al. | |

OTHER PUBLICATIONS

Rollins, Scott M. et al., "Engine System Having a Condensate Bypass Duct," U.S. Appl. No. 13/961,607, filed Aug. 7, 2013, 20 pages.

Rollins, Scott M. et al., "Air Intake Duct Ice Ingestion Features," U.S. Appl. No. 13/968,306, filed Aug. 15, 2013, 39 pages.

* cited by examiner

*Primary Examiner* — Marguerite McMahon

(74) *Attorney, Agent, or Firm* — Greg Brown; Alleman Hall McCoy Russell & Tuttle LLP

(57) ABSTRACT

An engine intake manifold is provided. The engine intake manifold includes a manifold chamber configured to receive positive crankcase ventilation (PCV) gas from a PCV conduit outlet, the manifold chamber including a condensate-containment tray with a plurality of baffles to form a plurality of separate cavities below the PCV conduit outlet.

17 Claims, 5 Drawing Sheets

ENGINE INTAKE MANIFOLD HAVING A CONDENSATE-CONTAINMENT TRAY

FIELD

The present disclosure relates to a condensate-containment tray in an engine intake manifold.

BACKGROUND AND SUMMARY

Positive crankcase ventilation (PCV) systems are provided in engines to reduce the amount of blow-by gasses escaping into the environment. Resultantly, PCV systems enable engine emissions to be reduced. However, positive crankcase ventilation (PCV) vapor contains a large fraction of water. Additionally, other sources of water may be present in the intake system, such as water vapor from an exhaust gas recirculation (EGR) system. The water vapor can condense on the cold air duct walls, intake conduits, and within the intake manifold. Further, the PCV vapor may freeze into ice downstream of the PCV port in the cold air duct. Following a diurnal cycle, the melted ice may drip and/or drain down to depressions in the intake system and re-freeze. Once the engine is restarted, the ice may melt and can move downstream to the cylinders. The condensate flowing into the cylinders degrades combustion and in some cases cause misfires in the cylinder, due to spark plug wetting.

U.S. Pat. No. 6,290,558 discloses a water trap in an exhaust system. The inventors have recognized several drawbacks with the water trap disclosed in U.S. Pat. No. 6,290,558. The structural features of water trap disclosed in U.S. Pat. No. 6,290,558 limits the amount of water that can be collected in the trap. Additionally, the features of the water trap also increase turbulence in the exhaust system.

As such in one approach, an engine intake manifold is provided. The engine intake manifold includes a manifold chamber configured to receive positive crankcase ventilation (PCV) gas from a PCV conduit outlet, the manifold chamber including a condensate-containment tray with a plurality of baffles to form a plurality of separate cavities below the PCV conduit outlet. It has been unexpectedly found that when the aforementioned structural features of the intake manifold, and in one example the condensate-containment tray, are provided in an engine, condensate can be collected and released into the cylinders at a desired rate which can reduce the likelihood of combustion degradation (e.g., misfires).

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

An intake manifold with a condensate-containment tray having a plurality of baffles that form a plurality of separate cavities below a PCV conduit outlet is described herein. The tray enables condensate from a positive crankcase ventilation (PCV) system as well as other sources to be collected before flowing into the cylinder. Consequently, the likelihood of misfires caused by condensate flowing into the cylinders is reduced. In one example, the condensate-containment tray may be positioned near or at a lower-most bottom of a manifold chamber. In this way, gravity may be used to collect condensate in the manifold. Moreover, positioning the tray in the aforementioned location, decreases flow interference in the intake manifold, thereby increasing intake system's efficiency.

Figure 1:
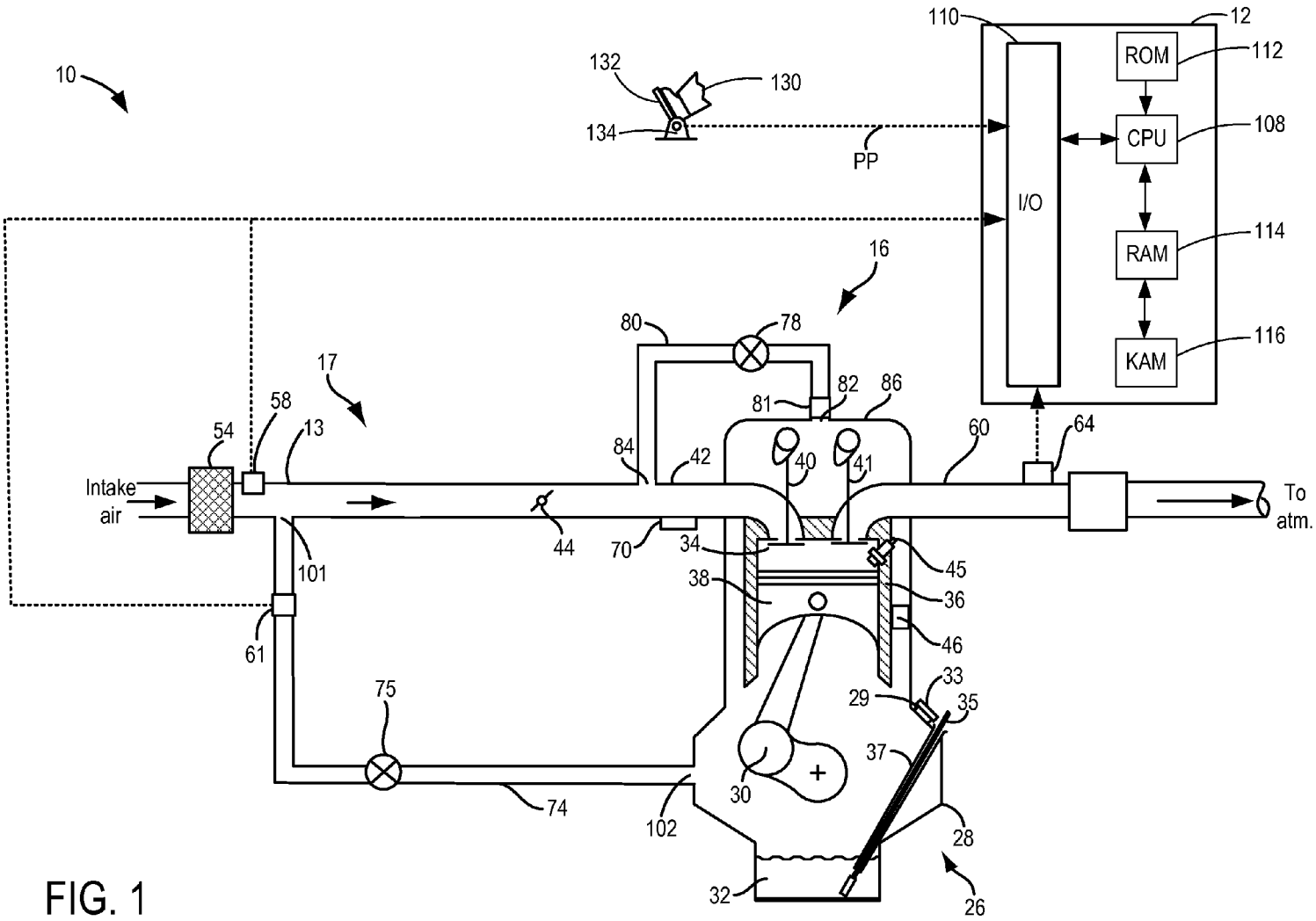
FIG. 1 shows a schematic depiction of an engine and intake manifold.

Referring now to FIG. 1, an example system configuration of a multi-cylinder engine, generally depicted at 10, which may be included in a propulsion system of an automobile, is shown. Engine 10 may be controlled at least partially by a control system including engine controller 12 and by input from a vehicle operator 130 via an input device 132. In this example, input device 132 includes an accelerator pedal and a pedal position sensor 134 for generating a proportional pedal position signal PP.

Engine 10 may include a lower portion of the engine block, indicated generally at 26, which may include a crankcase 28 encasing a crankshaft 30. Crankcase 28 contains gas and may include an oil sump 32, otherwise referred to as an oil well, holding engine lubricant (e.g., oil) positioned below the crankshaft. An oil fill port 29 may be disposed in crankcase 28 so that oil may be supplied to oil sump 32. Oil fill port 29 may include an oil cap 33 to seal oil fill port 29 when the engine is in operation. A dip stick tube 37 may also be disposed in crankcase 28 and may include a dipstick 35 for measuring a level of oil in oil sump 32. In addition, crankcase 28 may include a plurality of other orifices for servicing components in crankcase 28. These orifices in crankcase 28 may be maintained closed during engine operation so that a PCV system (described below) may operate during engine operation.

The upper portion of engine block 26 may include a combustion chamber (e.g., cylinder) 34. The combustion chamber 34 may include combustion chamber walls 36 with piston 38 positioned therein. Piston 38 may be coupled to crankshaft 30 so that reciprocating motion of the piston is translated into rotational motion of the crankshaft. Combustion chamber 34 may receive fuel from fuel injector 45 (configured herein as a direct fuel injector) and intake air from intake manifold 42 which is positioned downstream of throttle 44. The engine block 26 may also include an engine coolant temperature (ECT) sensor 46 input into an engine controller 12 (described in more detail below herein).

A throttle 44 may be disposed in the engine intake to control the airflow entering intake manifold 42. An air filter 54 may be positioned upstream the throttle 44 and may filter fresh air entering intake passage 13.

In one example, the engine 10 may include a compressor positioned upstream of the throttle 44 and downstream of the air filter 54. In such an example, PCV operation may be modified to account the change of pressure differential in an intake system 17. Specifically, the flow of PCV gases may be reversed. That is to say that crankcase gases may flow through the PCV conduit 74 into the intake passage 13 as opposed to PCV conduit 80. Furthermore, in such an example a turbine may be positioned in the exhaust system. It will be appreciated that the intake system 17 may include the air filter 54, the intake passage 13, the intake manifold 42, throttle 44, and the intake valve system 40.

The intake air may enter combustion chamber 34 via cam-actuated intake valve system 40. Likewise, combusted exhaust gas may exit combustion chamber 34 via cam-actuated exhaust valve system 41. In an alternate embodiment, one or more of the intake valve system and the exhaust valve system may be electrically actuated.

Exhaust combustion gases exit the combustion chamber 34 via exhaust passage 60 located upstream of emission control device 62. The emission control device 62 may be a filter, catalyst, etc. An exhaust gas sensor 64 may be disposed along exhaust passage 60 upstream of emission control device 62. Exhaust gas sensor 64 may be a suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. Exhaust gas sensor 64 may be connected with engine controller 12.

In the example of FIG. 1 a positive crankcase ventilation system (PCV) 16 is coupled to the engine intake so that gases in the crankcase may be vented in a controlled manner from the crankcase. The PCV system 16 is configured to draw air into crankcase 20 via a PCV conduit 74 that is coupled to the engine intake (e.g., intake passage 13) so that gasses in the crankcase may be vented in a controlled manner from the crankcase through the PCV conduit 80. A first end 101 of PCV conduit 74 may be mechanically coupled, or connected, to the intake manifold 42 upstream of the throttle 52. Specifically, the PCV conduit 74 may be coupled to the intake passage 13. In some examples, the first end 101 of PCV conduit 74 may be coupled to fresh air intake passage 13 downstream of air filter 54 (as shown). In other examples, the PCV conduit may be coupled to fresh air intake passage 13 upstream of air filter 54. A second end 102, opposite first end 101, of the PCV conduit 74 may be mechanically coupled, or connected, to crankcase 28. Thus, intake air may flow through the PCV conduit 74 into the crankcase during operation of the PCV system 16. A valve 75 may be coupled to the PCV conduit 74 and is configured to regulate the amount of air flowing therethrough. The valve 75 may be controlled via the controller 12 or may be passively operated.

Another PCV conduit 80 is include in the engine 10. The PCV conduit 80 includes an inlet 82 and an outlet 84. The inlet 82 extends through a cam cover 86 and into a portion of the engine in fluidic communication with the crankcase 28. An oil separator 81 may also be coupled to the PCV conduit 80. The oil separator 81 is configured to remove oil from the crankcase gases. Likewise, the outlet 84 opens into the intake manifold 42. Thus the outlet 84 is in fluidic communication with the intake manifold 42 and the cylinders. A PCV valve 78 is coupled to the PCV conduit 80. The PCV valve 78 is configured to regulate the amount of PCV gas flowing through the PCV conduit 80. In this way, crankcase gases may be flowed into the intake system 17.

The intake manifold 42 includes a condensate-containment tray 70 configured to receive condensate generated in the intake system. The condensate-containment tray 70 is positioned vertically below the outlet 84 of the PCV conduit 80. The condensate-containment tray 70 is schematically depicted via a box in the example shown in FIG. 1. However, it will be appreciated that the condensate-containment tray 70 has greater structural complexity discussed in greater detail herein with regard to FIGS. 2 and 3.

The crankcase gases may include blow-by of combustion gases from the combustion chamber to the crankcase. It will be appreciated that blow-by gasses are gasses that flow past the piston in the combustion chamber. The composition of the gases flowing through the conduit, including the humidity level of the gasses, may affect the humidity at locations downstream of the PCV conduit outlet in the intake system. Therefore, it will be appreciated that condensate may be present in the intake manifold 42 and the condensate-containment trap 70 may be configured to receive the condensate.

In some embodiments, PCV conduit 74 may include a pressure sensor 61 coupled therein. Pressure sensor 61 may be an absolute pressure sensor or a gauge sensor. One or more additional pressure and/or flow sensors may be coupled to the PCV system at alternate locations. In some examples, a pressure sensor 58 may be coupled in intake passage 13 downstream of air filter 54 to provide an estimate of the pressure in the intake passage 13.

Gas may flow through PCV conduit 74 in both directions, from crankcase 28 towards intake passage 13 and/or from intake passage 13 towards crankcase 28. For example, during non-boosted conditions, the PCV system vents air out of the crankcase and into intake manifold 42 via PCV conduit 74 which, in some examples, may include a one-way PCV valve 78 to provide continual evacuation of gases from inside the crankcase 28 before connection to the intake manifold 42. It will be appreciated that while the depicted example shows PCV valves (75 and/or 78) as a passive valve, this is not meant to be limiting, and in alternate embodiments, PCV valves (75 and/or 78) may be an electronically controlled valve (e.g., a powertrain control module (PCM) controlled valve) wherein a controller may command a signal to change a position of the valve from an open position (or a position of high flow) to a closed position (or a position of low flow), or vice versa, or any position there-between.

While not shown, it will be appreciated that engine 10 may further include one or more exhaust gas recirculation passages for diverting at least a portion of exhaust gas from the engine exhaust to the engine intake. As such, by recirculating some exhaust gas, an engine dilution may be affected which may improve engine performance by reducing engine knock, peak cylinder combustion temperatures and pressure, throttling losses, and NOx emission. The one or more EGR passages may include a low pressure (LP)-EGR passage coupled between the engine intake upstream of a turbocharger compressor and the engine exhaust downstream of the turbine, and configured to provide LP-EGR. The one or more EGR passages may further include a high pressure (HP)-EGR passage coupled between the engine intake downstream of the compressor and the engine exhaust upstream of the turbine, and configured to provide HP-EGR. In one example, HP-EGR flow may be provided under conditions such as the absence of boost provided by the turbocharger, while an LP-EGR flow may be provided during conditions such as the presence of turbocharger boost and/or when an exhaust gas temperature is above a threshold. The LP-EGR flow through the LP-EGR passage may be adjusted via an LP-EGR valve while the HP-EGR flow through the HP-EGR passage may be adjusted via an HP-EGR valve (not shown).

Under some conditions, the EGR system may be used to regulate the temperature of the air and fuel mixture within the combustion chamber, thus providing a method of controlling the timing of ignition during some combustion modes. Further, during some conditions, a portion of combustion gases may be retained or trapped in the combustion chamber by controlling exhaust valve timing, such as by controlling a variable valve timing mechanism.

It will be appreciated that, as used herein, PCV flow refers to the flow of gases through the PCV line. This flow of gases may include a flow of crankcase gases only, and/or a flow of a mixture of air and crankcase gases.

Engine controller 12 is shown in FIG. 1 as a microcomputer, including microprocessor unit 108, input/output ports 110, an electronic storage medium for executable programs and calibration values shown as read only memory chip 112 in this particular example, random access memory 114, keep alive memory 116, and a data bus. Engine controller 12 may receive various signals from sensors coupled to engine 10, including measurement of inducted mass air flow (MAF) from mass air flow sensor 58; engine coolant temperature (ECT) from temperature sensor 46; exhaust gas air/fuel ratio from exhaust gas sensor 64; etc. Furthermore, engine controller 12 may monitor and adjust the position of various actuators based on input received from the various sensors. These actuators may include, for example, throttle 44, intake and exhaust valve system 40, 41, PCV valve 75, and/or PCV valve 78. Storage medium read-only memory 112 can be programmed with computer readable data representing instructions executable by processor 108 for performing the methods described below, as well as other variants that are anticipated but not specifically listed thereof.

Figure 2:
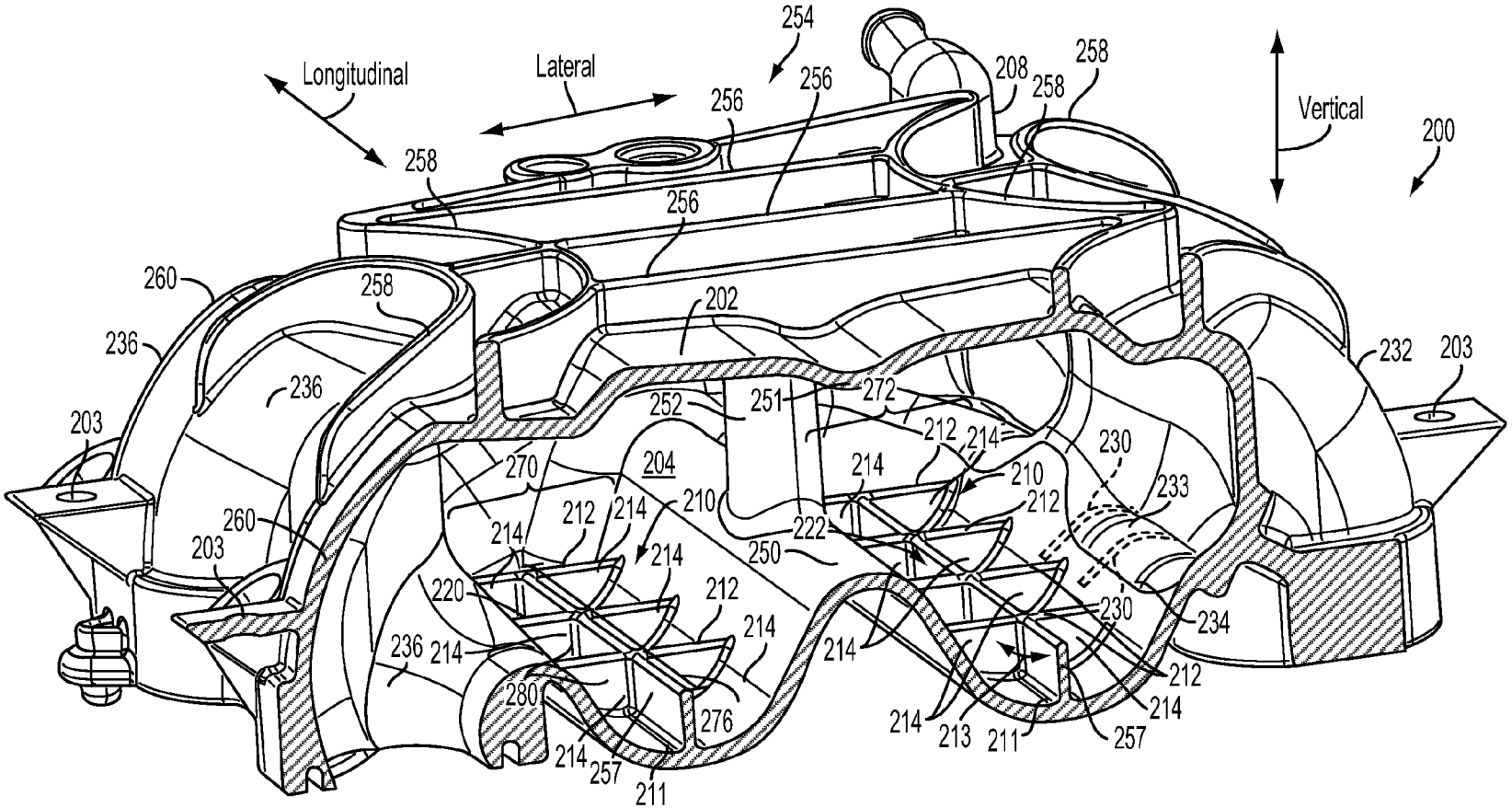
FIG. 2 shows an example engine intake manifold.
Figure 3:
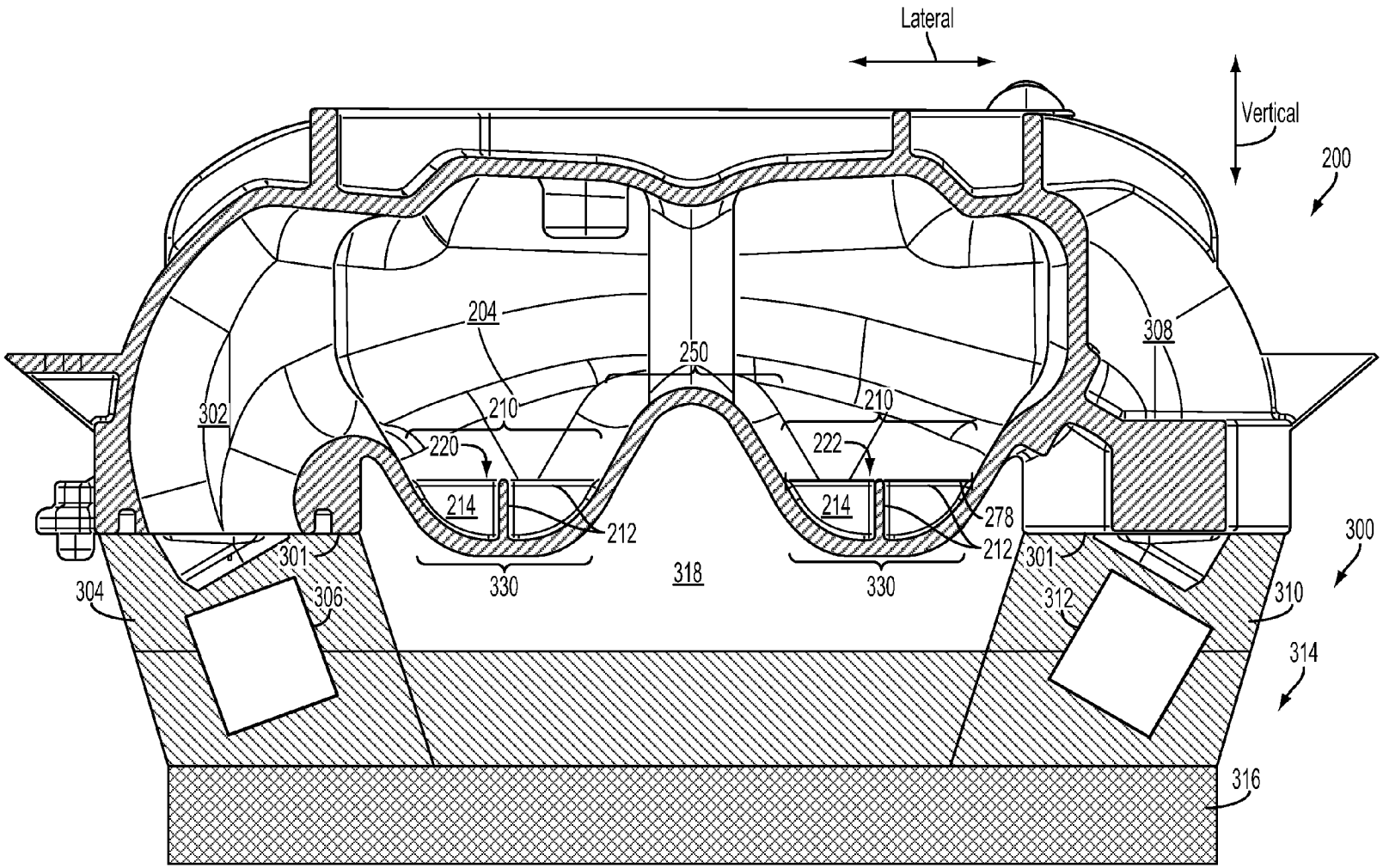
FIG. 3 shows another view of the engine intake manifold shown in FIG. 2.

FIG. 2 shows an illustration of an engine intake manifold 200. Specifically, a cut-away view of the engine intake manifold 200 is shown. Therefore, the engine intake manifold 200 may include additional structures extending in a longitudinal direction that are not depicted. It will be appreciated that the engine intake manifold 200 may be an example of the intake manifold 42 shown in FIG. 1 and therefore may be included in the engine 10 shown in FIG. 1. Further, FIGS. 2-3 are each drawn approximately to scale, although other relative dimensions may be used. For example, FIGS. 2-3 show example relatively dimensions, placement, spacing, etc. of the various elements described and illustrated therein. For example, components may be shown spaced apart from one another, contiguous with one another, adjacent one another, not adjacent one another, etc.

Figure 5:
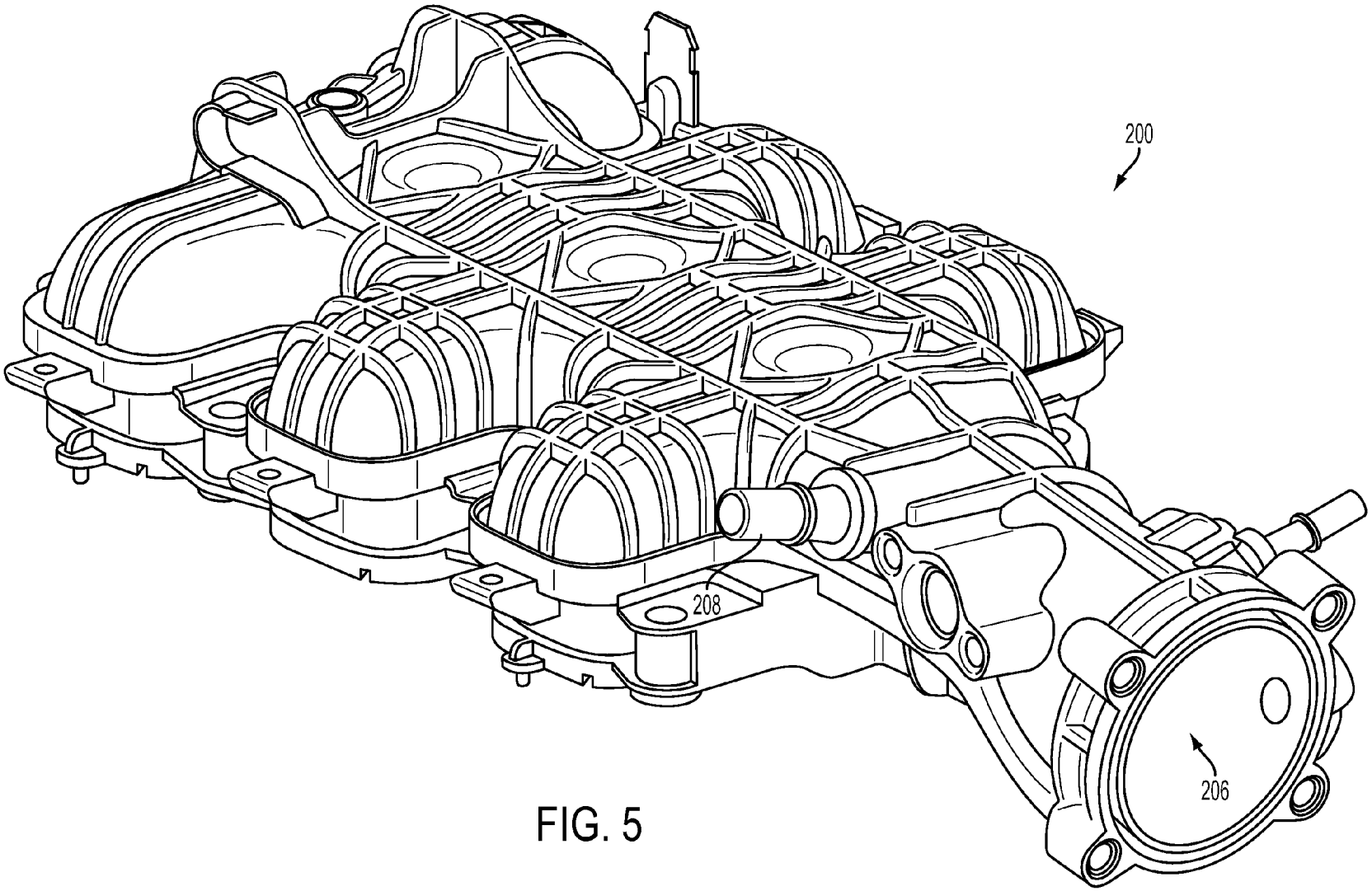
FIG. 5 shows another view of the engine intake manifold shown in FIG. 2.

As illustrated, the engine intake manifold 200 includes a housing 202. The housing 202 includes a plurality of attachment openings 203 configured to attach to other components in the engine. The housing 202 defines a boundary of a manifold chamber 204. The engine intake manifold 200 includes a manifold inlet 206, shown in FIG. 5, coupled to an upstream intake passage, such as intake passage 13, shown in FIG. 1. Thus, the engine intake manifold 200 receives intake air from an intake passage and is positioned downstream of a throttle. The engine intake manifold 200 further includes a PCV conduit outlet 208, shown in FIG. 5. Thus, the engine intake manifold 200 may receive crankcase gas via the PCV conduit outlet 208.

Continuing with FIG. 2, the engine intake manifold 200 includes a condensate-containment tray 210. It will be appreciated that condensate-containment tray 210 is an example of the condensate containment tray 70, shown in FIG. 1. Continuing with FIG. 2, the condensate-containment tray 210 may be positioned vertically below the PCV conduit outlet 208. A vertical axis is provided for reference. It will be appreciated that the vertical axis is drawn assuming the engine or vehicle in which the engine is positioned is on a level surface. When the tray is positioned in this way, condensate may flow to the tray via the assistance of gravitational forces. The condensate-containment tray 210 is positioned near a bottom 211 of the manifold chamber 204.

The condensate-containment tray 210 includes a plurality of baffles 212. As shown, a portion of the baffles 212 are longitudinally aligned and a portion of the baffles 212 are laterally aligned. A lateral axis and a longitudinal axis are provided for reference. Furthermore, the baffles 212 extend in a vertical direction. However, alternate baffle orientations have been contemplated. Additionally, at least a portion of the baffles 212 intersect at perpendicular angles. A baffle intersection angle is shown at 213. However, in other examples the baffles may intersect at non-perpendicular angles (e.g., angles less than or greater than 90 degrees).

The baffles 212 enable cavities 214 to be formed in the condensate-containment tray 210. Thus, the baffles 212 may define the boundary of the cavities 214. In one example, one or more of the baffles may define a portion of a boundary of two adjacent cavities. For example, two or more arrays of a plurality of adjacent cavities may be positioned in separate regions separated by a ridge 250 (e.g., ridge-shaped mound) therebetween.

Thus, it will be appreciated that the cavities 214 may be formed in two arrays (270 and 272) separated by the ridge 250. In the depicted example, each of the two arrays (270 and 272) has a length 276 longer than a width 278, shown in FIG. 3. The lengths of the arrays are aligned with one another and a cylinder bank, discussed in greater detail herein with regard to FIG. 3.

Continuing with FIG. 2, the ridge 250 is shown extending in a longitudinal direction. However, other contours, orientation, etc., of the ridge have been contemplated. The engine intake manifold 200 further includes a column 252 extending between a curved surface 251 in an upper portion of the housing 202 and the ridge 250. The column 252 may have a cylindrical or oval cross-sectional geometry, in one example. The column 252 provides support to the housing 202.

A plurality of ribs 254 are also included on an external portion of the engine intake manifold 200. Thus, the ribs 254 externally extend from the housing 202. The ribs 254 increase the structural integrity of the engine intake manifold 200. A set 256 of the ribs 254 extends straight across the housing 202 in a lateral direction. The set 256 of ribs 254 is transverse to the longitudinally aligned baffles 257. Thus, the set 256 of ribs are also transverse to the ridge-shaped mound 250. Another set 258 of the ribs 254 are curved and extend down the runners (232 and 236).

It will be appreciated that the cavities are configured to collect condensate. The baffles 212 are coupled to the housing 202. In one example, the baffles 212 and the housing 202 may form a continuous shape and may be integrally constructed.

In the depicted example, the condensate-containment tray 210 includes a first section 220 and a second section 222. The first section 220 is spaced away (e.g., laterally spaced away) from the second section 222. Adjacent cavities, such as cavities 280, in the plurality of cavities 214 in each of the sections (220 and 222) are contiguous with one another and extend longitudinally across multiple runners (i.e., runners 236). Specifically in one example, cavities in each of the sections (220 and 222) extend down a length of a cylinder bank from a first outer runner 260 to a second outer runner 262. It will be appreciated that the outer runners are positioned at the longitudinal periphery of the corresponding cylinder bank. In such an example, adjacent cavities in a longitudinal direction are contiguous and the parting lines between the cavities are defined by the baffles. However, in other examples the sections may be adjacent to one another. Each of the sections (220 and 222) is positioned in a depression in the housing 202.

The housing 202 may include one or more grooves 230. The grooves 230 extend from one of the cavities into an intake runner 232. As shown, the grooves 230 extend in a vertical and lateral direction. Specifically in the depicted example, the grooves 230 extend over a peak 233 of a ridge 234 in the housing 202. Thus, the grooves 230 traverse the ridge 234 in the manifold chamber 204. As shown, the grooves 230 are curved.

A side of the ridge 234 defines a boundary of a portion of the cavities 214. Furthermore, the peak 233 of the ridge 234 is positioned above the cavities 214. Additionally in the depicted example, the ridge 234 extends in a longitudinal direction.

It will appreciated that the grooves are basically indents (e.g., recesses) in the housing and enable condensate to be channeled into the runner at a desired rate which decreases the likelihood of combustion degradation (e.g., cylinder misfires). The engine intake manifold 200 further includes additionally intake manifold runners 236, discussed in greater detail herein with regard to FIG. 3.

FIG. 3 shows another view of the engine intake manifold 200 shown in FIG. 2. The condensate-containment trays 210 and manifold chamber 204 are shown in FIG. 3. As shown, the engine intake manifold 200 coupled to a cylinder head 300. A cylinder head attachment interface 301 is shown in FIG. 3 and included in the engine intake manifold 200. Specifically, a first set of intake runners 302 is coupled to a cylinder bank 304 including one or more cylinder 306. The cylinders are schematically depicted. However, it will be appreciated that the cylinders have greater complexity that is not shown. A second set of intake runners 308 is coupled to a second cylinder bank 310 including one or more cylinders 312. The cylinder head 300 may be coupled to an engine block 314 to form the cylinders (306 and 312). Additionally, the engine block 314 may be coupled to an oil sump 316 configured to receive lubricant from the engine. It will be appreciated that in one example the cylinders in the separate cylinder banks (304 and 310) are arranged at non-straight angles to form a V-type cylinder configuration.

A valley 318 is formed between the cylinder banks (304 and 310). As shown, a portion of the condensate-containment tray 210 is positioned within the valley 318. In this way, the compactness of the engine is increased.

As shown, the housing 202 includes curved sections 330 and the ridge 250. The curved sections 330 and the ridge 250 cooperate to form a wall having a sinusoidal-type cross-sectional shape. Thus, the peak of the sinusoidal shape forms the ridge 250. The interior valleys of the curved sections 330 hold the condensate-containment tray 210. It will be appreciated that the ridge 250 divides the sections (220 and 222) of the tray 210. The baffles 212 of the tray 210 are shown which form a portion of the boundaries of the cavities 214.

Figure 4:
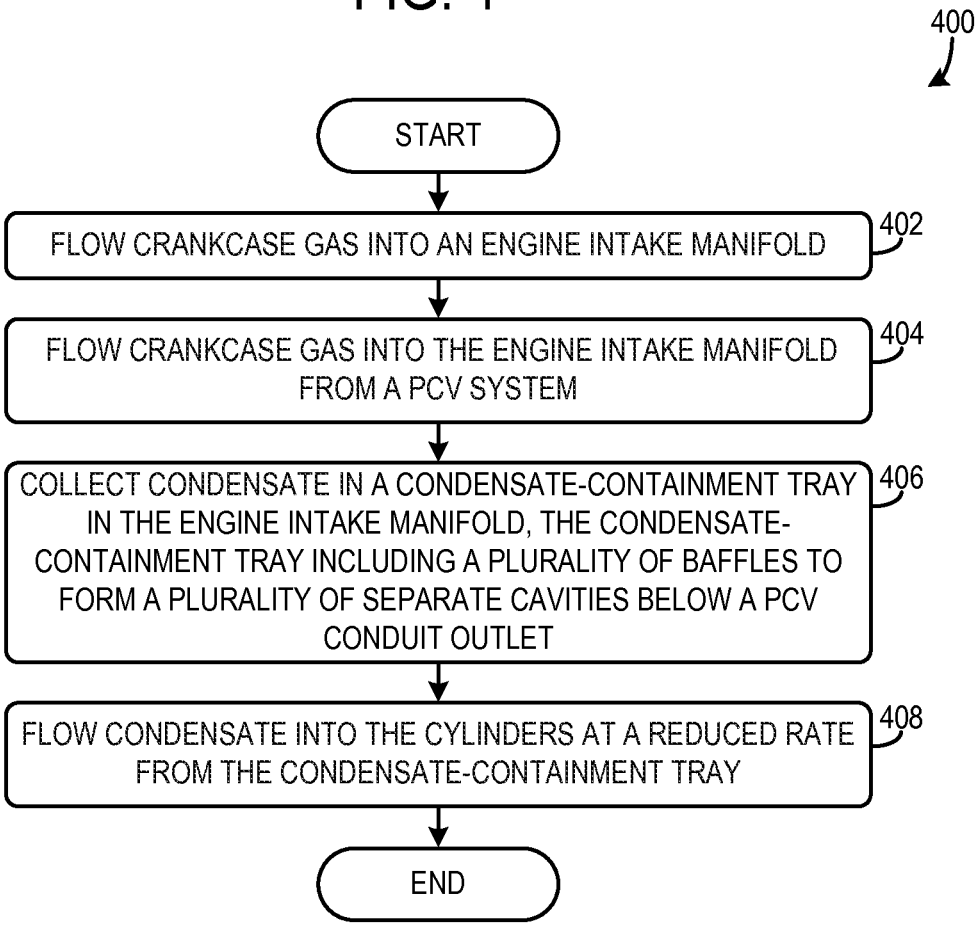
FIG. 4 shows a method for operation of an intake system.

FIG. 4 shows a method 400 for operation of an intake system. The method 400 may be implemented via the intake system described above with regard to FIGS. 1-3 or may be implemented via another suitable intake system.

At 402 the method includes flowing crankcase gas into an engine intake manifold and at 404 the method includes flowing crankcase gas into the engine intake manifold from a PCV system.

Next at 406 the method includes collecting condensate in a condensate-containment tray in the engine intake manifold, the condensate-containment tray including a plurality of baffles to form a plurality of separate cavities below a PCV conduit outlet. Next at 408 the method includes flowing condensate into the cylinders at a reduced rate from the condensate-containment tray.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine intake manifold comprising:

a manifold chamber configured to receive positive crankcase ventilation (PCV) gas from a PCV conduit outlet, the manifold chamber including a condensate-containment tray with a plurality of baffles forming a plurality of separate cavities below the PCV conduit outlet, where at least a portion of the condensate-containment tray is positioned in a valley between two cylinder banks; and one or more intake manifold runners coupled to each of the cylinder banks.

2. The engine intake manifold of claim 1, where the manifold chamber includes a housing comprising at least one groove extending from at least one of the separate cavities into an intake manifold runner coupled to an engine cylinder.

3. The engine intake manifold of claim 2, where the grooves are curved and extend in a vertical and lateral direction.

4. The engine intake manifold of claim 3, where the grooves extend over a peak of a ridge defining a boundary of one side of one of the separate cavities, the peak of the ridge positioned above the separate cavities.

5. The engine intake manifold of claim 1, where the baffles extend in a vertical direction.

6. The engine intake manifold of claim 1, where one or more of the baffles define a portion of a boundary of two adjacent cavities.

7. The engine intake manifold of claim 1, where the condensate-containment tray is positioned near or at a lower-most bottom of the manifold chamber.

8. The engine intake manifold of claim 1, where cylinders in the two cylinder banks are arranged at non-straight angles to form a V-type cylinder configuration.

9. The engine intake manifold of claim 1, where the baffles are coupled to a housing defining a boundary of the manifold chamber.

10. An engine intake manifold comprising:

a manifold chamber configured to receive positive crankcase ventilation (PCV) gas from a PCV conduit outlet, the manifold chamber including a condensate-containment tray, where a portion of the condensate-containment tray is positioned vertically below a cylinder head attachment interface included in the engine intake manifold.

11. An engine comprising:

a throttle; and an intake manifold positioned downstream of the throttle, the intake manifold including:

a manifold chamber coupled to a PCV conduit outlet and including a condensate-containment tray having a plurality of baffles forming a plurality of separate cavities below the PCV conduit outlet, where at least a portion of the baffles are laterally aligned; and a cylinder positioned downstream of the intake manifold.

12. The engine of claim 11, where the condensate-containment tray is positioned near or at a lower-most bottom of the manifold chamber.

13. The engine of claim 11, where the condensate-containment tray is positioned in a valley between two cylinder banks and the engine intake manifold further comprises one or more intake manifold runners coupled to each of the cylinder banks.

14. The engine of claim 13, where the baffles extend in a vertical direction, and where the cavities are formed in two arrays separated by a ridge, each of the two arrays having a length longer than a width, the lengths aligned with one another and the cylinder banks.

15. An engine intake manifold comprising:

a manifold chamber configured to receive positive crankcase ventilation (PCV) gas from a PCV conduit outlet, the manifold chamber including a condensate-containment tray having a plurality of baffles extending in a vertical direction and forming a plurality of separate cavities positioned below the PCV conduit outlet and the manifold chamber further including a housing comprising at least one groove extending from at least one of the separate cavities into an intake manifold runner coupled to an engine cylinder.

16. The engine intake manifold of claim 15, where the baffles intersect at perpendicular angles.

17. The engine intake manifold of claim 15, where the baffles intersect at non-perpendicular angles.

* * * * *